US009038739B2

(12) United States Patent
Manwill et al.

(10) Patent No.: US 9,038,739 B2
(45) Date of Patent: May 26, 2015

(54) OIL-WELL TUBULAR ANCHORING SYSTEM FOR LWD/MWD TOOLS

(75) Inventors: Daniel Manwill, Provo, UT (US); Jonathan Marshall, Provo, UT (US); Jacques Orban, Provo, UT (US); Ray R. Sherrill, Yukon, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 436 days.

(21) Appl. No.: 13/475,038

(22) Filed: May 18, 2012

(65) Prior Publication Data

US 2013/0307266 A1 Nov. 21, 2013

(51) Int. Cl.

| | |
|---|---|
| ***E21B 17/02*** | (2006.01) |
| ***E21B 47/01*** | (2012.01) |
| ***E21B 17/042*** | (2006.01) |
| ***E21B 23/02*** | (2006.01) |

(52) U.S. Cl.
CPC ..... *E21B 47/01* (2013.01); *E21B 17/042* (2013.01); *E21B 23/02* (2013.01)

(58) Field of Classification Search
CPC ..... E21B 17/042; E21B 23/02; E21B 47/01
USPC ..... 166/243, 382, 378; 175/312, 314; 138/108; 285/123.1, 123.3, 123.5, 285/123.8, 123.14, 123.15, 124.3
See application file for complete search history.

(56) References Cited

U.S. PATENT DOCUMENTS

| | | | | |
|---|---|---|---|---|
| 2,668,066 | A * | 2/1954 | Stadelhofer | 285/363 |
| 3,065,807 | A * | 11/1962 | Wells | 175/321 |
| 4,094,360 | A * | 6/1978 | Nelson | 166/243 |
| 4,328,865 | A | 5/1982 | Hall | |
| 5,398,763 | A * | 3/1995 | Watson et al. | 166/382 |
| 6,554,324 | B1 | 4/2003 | Herman | |
| 7,201,240 | B2 * | 4/2007 | Hall et al. | 175/320 |
| 2002/0148617 | A1 | 10/2002 | Dewey et al. | |
| 2006/0065444 | A1 * | 3/2006 | Hall et al. | 175/314 |
| 2007/0056723 | A1 * | 3/2007 | Hall et al. | 166/65.1 |
| 2007/0137853 | A1 * | 6/2007 | Zhang et al. | 166/65.1 |
| 2009/0058675 | A1 | 3/2009 | Sugiura | |
| 2011/0061862 | A1 | 3/2011 | Loretz et al. | |

FOREIGN PATENT DOCUMENTS

| | | | |
|---|---|---|---|
| WO | WO/2010/101549 | * 10/2010 | E21B 17/02 |

OTHER PUBLICATIONS

International Search Report issued in PCT/US2013/041711 mailed Jul. 24, 2013 (3 pages).
Written Opinion of the International Searching Authority issued in PCT/US2013/041711 mailed Jul. 24, 2013 (7 pages).

* cited by examiner

*Primary Examiner* — Jennifer H Gay
*Assistant Examiner* — Steven MacDonald
(74) *Attorney, Agent, or Firm* — Kimberly Ballew

(57) ABSTRACT

An anchoring assembly in a downhole tool, the assembly including a first tubular member, a second tubular member coupled to the first tubular member, and an anchoring block disposed between the first tubular member and the second tubular member. The anchoring block includes a body having a central axis defined therethrough and a central bore formed therethrough, a contact crown, in which at least one annular flow channel is formed between the contact crown and the body, and a contact ring configured to engage at least a portion of the first tubular member.

11 Claims, 9 Drawing Sheets

OIL-WELL TUBULAR ANCHORING SYSTEM FOR LWD/MWD TOOLS

BACKGROUND

The oil and gas industry uses various tools to probe the formation penetrated by a borehole in order to locate hydrocarbon reservoirs and to determine the types and quantities of the hydrocarbons. These tools may be used to probe the formations after the well is drilled, e.g., as wireline tools. Alternatively, these tools or measurement systems may be included in a drilling system and make measurements while drilling, e.g., measurement-while-drilling (MWD) tools or logging-while-drilling (LWD) tools. It is common practice to attach such devices and measurement systems in well-bore tubulars. Such tubulars can include drill-collars, drill-pipes, production tubing, and well casing. Generally, the measurement systems are contained within a housing installed at the center of a drill collar. The housing is kept centralized by centralizers or hangers and may be held in place by an axial lock system or radial lock system which passes through the collar wall and are often threaded in the housing stabilizer or hanger.

Some MWD tools are fishable and can be removed from the drill collar by fishing methods typically using slick-line tools. Such fishable MWD tools can also be re-installed in the drill collar when the drill string is in the well bore. This installation is commonly performed by lowering the MWD at the extremity of the slick-line terminated by an adequate fishing tool. Referring to FIG. 1, a fishable MWD tool 101 is shown. The fishable MWD tool 101 may be provided with a fishing head 103, a modulator 104, a stinger 105, and the fishable MWD tool 101 may be installed in a drill collar 102. Further, the fishable MWD tool 101 may be supported within the drill collar 102 at multiple points within the drill collar 102 with one or more MWD centralizers 106. Further, a Universal Bottom Hole Orientation Sub (UBHO) 107 may also be required. The included stinger 105 is guided in the UBHO and rotated at a preferred tool face, allowing proper referencing of tool face measurement.

In production tubing, seating nipples and landing nipples are components designed to accept and retain various wireline retrievable flow controls, the most common being plugs, chokes, and pressure and temperature gauges. A specific tubing length is commonly added to allow such an attachment. In production tubing, the use of landing nipples is common. Referring to FIG. 2, a conventional seating nipple 200 is shown. Depending of the shape of the landing element, a landed or attached device (not shown) may support force in several directions, e.g., in upward or in downward directions. The device may be disposed within a bore 208 formed through the nipple 200. The latching of the device in or against the landing nipple 200 involves shouldering the device such that the device is in contact with the proper area of the landing nipple, e.g., a shoulder section 209 of the nipple 200.

SUMMARY

According to one aspect, there is provided an anchoring assembly in a downhole tool, the assembly including a first tubular member, a second tubular member coupled to the first tubular member, and an anchoring block disposed between the first tubular member and the second tubular member. The anchoring block includes a body having a central axis defined therethrough and a central bore formed therethrough, a contact crown, in which at least one annular flow channel is formed between the contact crown and the body, and a contact ring configured to engage at least a portion of the first tubular member.

According to another aspect, there is provided an anchoring apparatus, the apparatus including a body having a central axis defined therethrough and a central bore formed therethrough, a contact crown, in which at least one annular flow channel is formed between the contact crown and the body, and a contact ring configured to engage at least a portion of the first tubular member.

According to another aspect, there is provided a method of assembling an anchoring assembly, the method including providing a first tubular member and a second tubular member, providing a gauge apparatus, the gauge apparatus including an external member having a first end, a second end, a central axis defined therethrough, and a central bore formed therethrough, and an internal member disposed within the central bore of the external member, the internal member having a first end, a second end, and a central bore formed therethrough, engaging each of the second end of the external member and the second end of the internal member of the gauge apparatus with the second tubular member, disengaging the second end of the external member of the gauge apparatus from the second tubular member, disposing an anchoring block into the central bore of the internal member of the gauge apparatus, engaging each of the first end of the external member and the first end of the internal member of the gauge apparatus with the first tubular member, and selecting a contact ring for the anchoring block based on a displacement of the internal member of the gauge apparatus.

Other aspects and advantages of the invention will be apparent from the following description and the appended claims.

DETAILED DESCRIPTION

Figure 1:
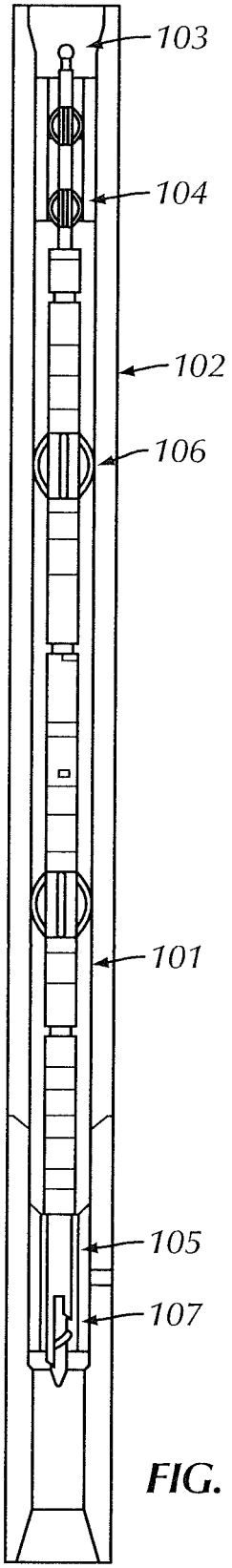
FIG. 1 shows a cross-sectional view of a conventional fishable MWD tool disposed within a drill collar.
Figure 2:
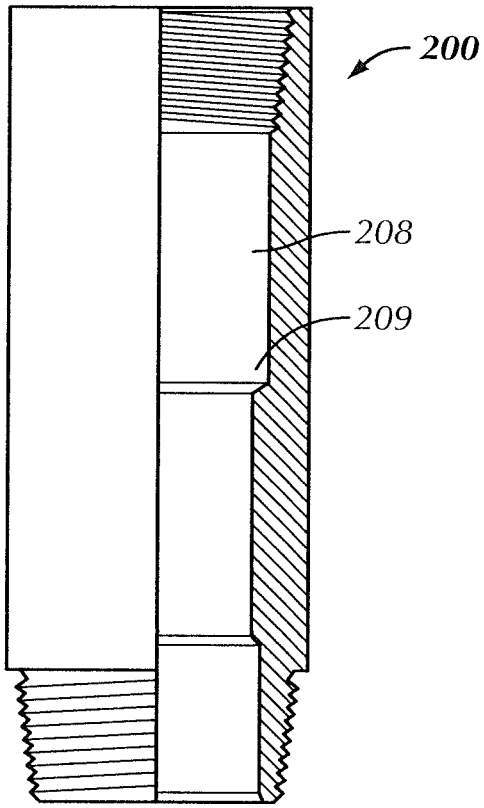
FIG. 2 shows a cross-sectional view of a conventional seating nipple.

In one aspect, embodiments disclosed herein relate to an anchoring assembly for anchoring LWD/MWD tools within a drill string used in the oil and gas industry for logging and measuring drilling conditions while drilling boreholes. Embodiments of the present disclosure also relate to an anchoring apparatus for anchoring LWD/MWD tools within a drill string that may be adapted to be used in various downhole tubulars and tubular connections. In other words, one or more embodiments disclosed herein may not require specialized or specific tubulars or tubular connections to be employed downhole. Anchoring assemblies and anchoring apparatuses, according to embodiments disclosed herein, may securely lock and anchor an anchoring system as well as various downhole tools within a tubular connection. Further, anchoring assemblies and anchoring apparatuses, according to embodiments disclosed herein, may promote an unmodified angular position of the elements of a tubular connection relative to each other under a specific torque threshold. In other words, anchoring assemblies and anchoring apparatuses, according to embodiments disclosed herein, may promote locking between elements of a tubular connection and may resist relative torque between the elements. Illustrations of each of these embodiments are shown.

Certain terms are used throughout the following description and claims refer to particular features or components. As those having ordinary skill in the art will appreciate, different persons may refer to the same feature or component by different names. This document does not intend to distinguish between components or features that differ in name but not function. The figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Further, the terms "axial" and "axially" generally mean along or substantially parallel to a central or longitudinal axis, while the terms "radial" and "radially" generally mean perpendicular to a central, longitudinal axis.

According to one or more embodiments, an anchoring assembly in a downhole tool may include a first tubular member, a second tubular member coupled to the first tubular member, and an anchoring block disposed between the first tubular member and the second tubular member. In one or more embodiments, the anchoring block, or anchoring apparatus, may include a body having a central axis defined therethrough and a central bore formed therethrough, a contact crown, in which at least one annular flow channel is formed between the contact crown and the body, and a contact ring configured to engage at least a portion of the first tubular member.

Further, according to one or more embodiments, the anchoring block may include at least one biasing member disposed between the contact ring and the contact crown and may be configured to bias the anchoring block toward one of the first tubular member and the second tubular member. In one or more embodiments, the at least one biasing member disposed between the contact ring and the contact crown may be configured to bias the contact ring toward the first tubular member and may be configured to bias the contact crown toward the second tubular member.

In one or more embodiments, the central bore of the body of the anchoring block may be configured to receive at least one tool such as a measurement tool or device, e.g., a sensor module or data logger including an MWD and/or an LWD tool. Further, in one or more embodiments, the anchoring block may include an alignment member formed on an inner surface of the central bore of the body, in which the alignment member is configured to align the at least one tool disposed within the central bore of the body of the anchoring block. For example, in one or more embodiments, the alignment member may be a protrusion that is configured to engage with a corresponding groove, slot, or recess formed on a surface of the at least one tool. Alternatively, in one or more embodiments, the alignment member may be a groove, slot, or recess that is configured to engage with a corresponding protrusion formed on a surface of the at least one tool.

Furthermore, in one or more embodiments, the anchoring block may include a lock pin, in which the lock pin may be disposed in the contact crown of the anchoring block. In one or more embodiments, the lock pin may be disposed in the contact crown of the anchoring block in a direction that is substantially parallel to the central axis of the anchoring block. Alternatively, in one or more embodiments, the lock pin may be disposed in the contact crown of the anchoring block in a direction that is not parallel to the central axis of the anchoring block. In one or more embodiments, a lower portion of the contact crown of the anchoring block may include a tapered portion, in which the tapered portion of the contact crown is configured to engage at least a portion of the second tubular member. Moreover, in one or more embodiments, at least one connection wing may extend radially between the body and the contact crown of the anchoring block.

Figure 3:
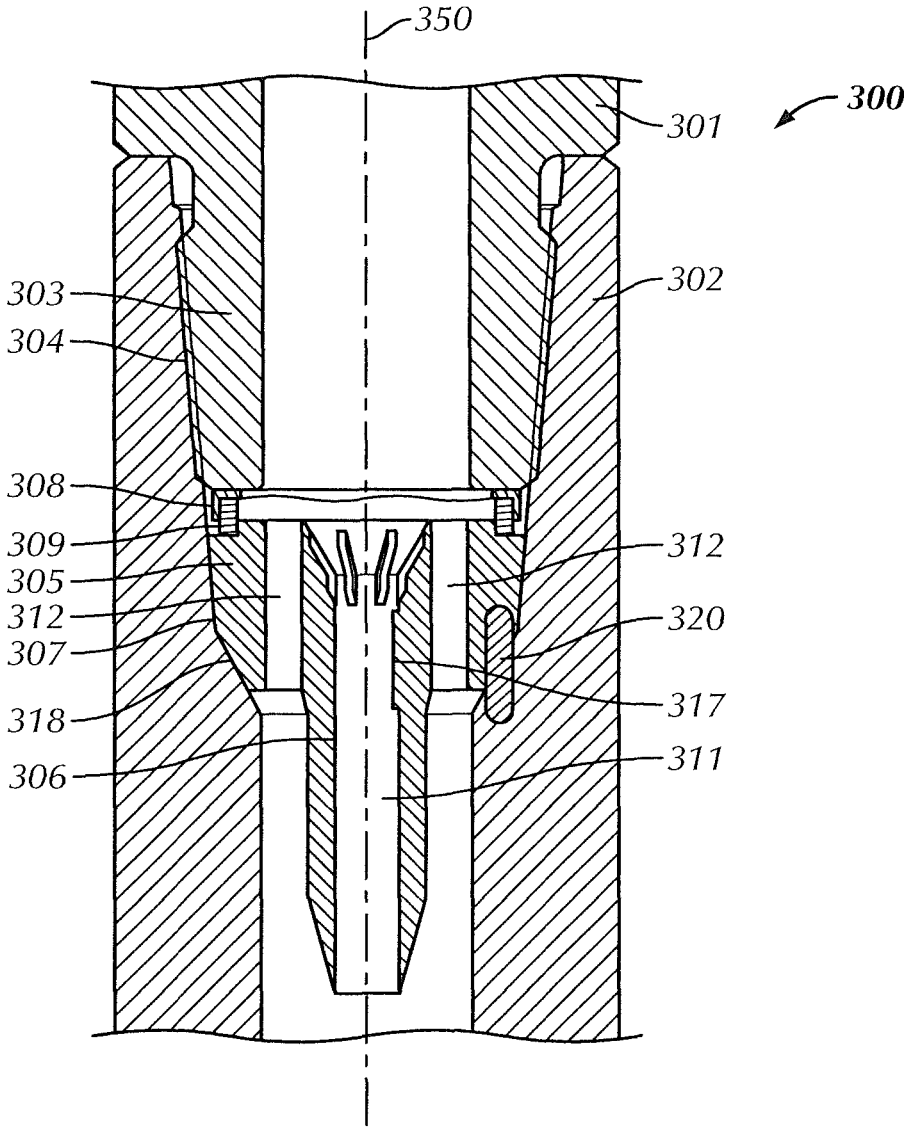
FIG. 3 shows a cross-sectional view of an anchoring assembly according to embodiments disclosed herein.

Referring to FIG. 3, a cross-sectional view of an anchoring assembly 300, in accordance with embodiments disclosed herein, is shown. As shown, the anchoring assembly 300 includes a first tubular member 301, a second tubular member 302 that is coupled to the first tubular member 301, and an anchoring block 305 that is disposed between the first tubular member 301 and the second tubular member 302. In one or more embodiments, the first tubular member 301 may be threadably coupled to the second tubular member 302. In other words, in one or more embodiments, the first tubular member 301 may include a male pin connection 303 that is configured to threadably engage with a female box connection 304 of the second tubular member 302. Alternatively, in one or more embodiments, the first tubular member may include a female box connection that is configured to threadably engage with a male pin connection of the second tubular member. However, those having ordinary skill in the art will appreciate that the first tubular member 301 may be coupled to the second tubular member 302 in any way known in the art and is not limited to threaded connections.

In one or more embodiments, each of the first tubular member 301 and the second tubular member 302 may have a bore formed therethrough. In one or more embodiments, each of the bore formed through the first tubular member 301 and the bore formed through the second tubular member 302 may be configured to allow fluid to flow through each of the first tubular member 301 and the second tubular member 302. Further, in one or more embodiments, the bore formed through the first tubular member 301 may be concentric to the bore formed through the second tubular member 302. Furthermore, a diameter of the bore formed through the first tubular member 301 may be substantially equal to a diameter of the bore formed through the second tubular member 302 and vice versa. However, those having ordinary skill in the art will appreciate that the bore formed through the first tubular member 301 and the bore formed through the second tubular member 302 may not necessarily be concentric or equal in diameter.

As shown, the anchoring block 305 includes a body 306, a contact crown 307, and a contact ring 308. In one or more embodiments, the body 306 of the anchoring block 305 may have a central bore 311 formed therethrough and a central axis 350 defined therethrough. In one or more embodiments, the central bore 311 of the body 306 may be configured to receive at least one tool (not shown), e.g., an MWD tool and/or an LWD tool. Those having ordinary skill in the art will appreciate that the central bore 311 of the body 306 of the anchoring block 305 can be configured to receive any measurement tool(s) and/or logging tool(s) known in the art. Alternatively, the central bore 311 of the body 306 of the anchoring block 305 can be configured to receive other downhole tools or components that are not MWD tools or LWD tools. For example, in one or more embodiments, the central bore 311 of the body 306 may be configured to receive a dart (not shown) that may be part of a fishable MWD system.

In one or more embodiments, the anchoring block 305 may include an alignment member 317 formed on an inner surface of the central bore 311 of the body 306. In one or more embodiments, the alignment member 317 may be configured to align at least one tool (not shown), e.g., an MWD tool and/or an LWD tool discussed above, disposed within the central bore 311 of the body 306 of the anchoring block 305. As discussed above, in one or more embodiments, the alignment member 317 may be a protrusion that is configured to engage with a corresponding groove, slot, or recess (not shown) formed on a surface of the at least one tool. Alternatively, in one or more embodiments, the alignment member may be a groove, slot, or recess that is configured to engage with a corresponding protrusion formed on a surface of the at least one tool. In one or more embodiments, the alignment member 317 may be used to control or measure the tool face of a tool that is disposed within the central bore 311 of the anchoring block 305 by assisting with a specific alignment of the tool within the central bore 311.

Further, in one or more embodiments, the contact crown 307 may be configured to engage with or contact at least a portion of the second tubular member 302. For example, in one or more embodiments, an outer surface of the contact crown 307 of the anchoring block 305 may be contoured or shaped to substantially match that of an inner surface of the female box connection portion 304 of the second tubular member 302. In one or more embodiments, a lower portion of the contact crown 307 of the anchoring block 305 includes a tapered portion 318, in which the tapered portion 318 of the contact crown 307 is configured to engage at least a portion of the second tubular member 302, e.g., a portion of the female box connection 304 of the second tubular member 302.

Furthermore, in one or more embodiments, the contact ring 308 may be configured to engage or contact at least a portion of the first tubular member 301, e.g., an end portion of the male pin connection 303 of the first tubular member 301. The contact ring 308 may be formed from any material known in the art. For example, the contact ring 308 of the anchoring block 305 may be formed from metals, plastics, composites, silicon, or any combination thereof. The contact ring 308 may be coupled or engaged directly or indirectly with the contact crown 307 and/or the body 306 of the anchoring block 305. In one or more embodiments, the contact ring 308 may be substituted with a similar contact ring having a different thickness in order to securely engage the anchoring block 305 between the first tubular member 301 and the second tubular member 302. In other words, in one or more embodiments, the contact ring 308 may be substituted for another contact ring having a different thickness, which may be more appropriate in order to ensure secure engagement between the anchoring block 305 and each of the first tubular member 301 and the second tubular member 302, such that any space between the anchoring block 305 and each of the first tubular member 301 and the second tubular member 302 may be minimized.

Still referring to FIG. 3, in one or more embodiments, the anchoring block 305 may include at least one biasing member 309. As shown in FIG. 3, the biasing member 309 is disposed between the contact ring 308 and the contact crown 307 of the anchoring block 305. In one or more embodiments, the biasing member 309 is configured to bias the anchoring block 305 toward one of the first tubular member 301 and the second tubular member 302. For example, in one or more embodiments, the biasing member 309 may be configured to bias the contact ring 308 of the anchoring block 305 toward the first tubular member 301 and may be configured to bias the contact crown 307 of the anchoring block toward the second tubular member 302.

In one or more embodiments, the biasing member 309 may create or reinforce an axial force between the anchoring block 305 and each of the first tubular member 301 and the second tubular member 302 to resist relative torque between the anchoring block 305 and each of the first tubular member 301 and the second tubular member 302. Shock or vibration during downhole use may cause relative torque between the anchoring block 305 and each of the first tubular member 301 and the second tubular member 302. In one or more embodiments, the biasing member 309 may provide or reinforce enough axial force between the anchoring block 305 and each of the first tubular member 301 and the second tubular member 302 to effectively secure a tool (not shown), e.g., an MWD and/or an LWD tool, with the tubular connection and maintain a set angular position of the tool relative to the tubular connection. Those having ordinary skill in the art will appreciate that a biasing member 309, according to embodiments disclosed herein, may be any device or mechanism that is configured to exert a force on, or bias, an article, e.g., the contact ring 308 and/or the contact crown 307, in a given direction. For example, in one or more embodiments, the biasing member 309 may be one or more springs.

Further, one or more embodiments of the anchoring block 305 may not necessarily include at least one biasing member 309. For example, in one or more embodiments, the contact ring 308 may be formed from a material, e.g., from metals, plastics, composites, silicon, or any combination thereof discussed above, that may possess some elasticity or plasticity to provide a secure engagement between the anchoring block 305 and each of the first tubular member 301 and the second tubular member 302. For example, in one or more embodiments, the contact ring 308 may be formed from a material that possesses elasticity or plasticity that is comparable to that of a biasing member, e.g., the biasing member 309. Further, the dimensions of the contact ring 308 may be specific to the amount of space that should be occupied in order to ensure secure engagement between the anchoring block 305 and each of the first tubular member 301 and the second tubular member 302. Such a contact ring may create or reinforce an axial force between the anchoring block 305 and each of the first tubular member 301 and the second tubular member 302 to resist relative torque between the first tubular member 301 and the second tubular member 302 without the use of at least one biasing member.

Furthermore, in one or more embodiments, the anchoring block 305 may include a lock pin 320. In one or more embodiments, the lock pin 320 may be disposed in the contact crown 307 of the anchoring block 305. As shown, the lock pin 320 is disposed in the contact crown 307 of the anchoring block 305 in a direction that is substantially parallel to the central axis 350 of the anchoring block 305. Alternatively, in one or more embodiments, the lock pin 320 may be disposed in the contact crown 307 of the anchoring block 305 in a direction that is not parallel to the central axis 350 of the anchoring block 305. In one or more embodiments, the lock pin 320 may increase the amount of relative torque between the first tubular member 301 and the second tubular member 302 onto the anchoring block 305. In other words, the lock pin 320 may promote an unmodified angular position of the anchoring block 305 versus the elements of a tubular connection consisting of the first tubular member 301 and the second tubular member 302 while the tubular connection is in use downhole.

In one or more embodiments, a mechanical feature of the tubular connection may be to transmit high torque. The lock pin 320, in accordance with embodiments disclosed herein, may provide or reinforce the torque resistance between the anchoring block 305 and the second tubular member 302 to effectively secure a tool (not shown), and may maintain a set angular position of the tool relative to the tubular connection. The lock pin 320 may be formed from any material known in the art. For example, in one or more embodiments, the lock pin 320 may be formed from any material that is substantially rigid and/or may provide some resistance to relative torque between anchoring block 305 and the second tubular member 302.

In one or more embodiments, at least one annular flow channel 312 may be formed between the contact crown 307 and the body 306, and at least one connection wing (not shown) extends radially between the body 306 and the contact crown 307 of the anchoring block 305. The annular flow channel 312 may allow fluid to flow or move through the anchoring block 305. As discussed above, both the first tubular member 301 and the second tubular member 302 may include a bore formed therethrough. The annular flow channel 312 formed through the anchoring block 305 may allow a fluid to flow through the bore formed through the first tubular member 301, through the annular flow channel 312 and, as a result, through the anchoring block 305, and through the bore formed through the second tubular member 302.

Figure 4:
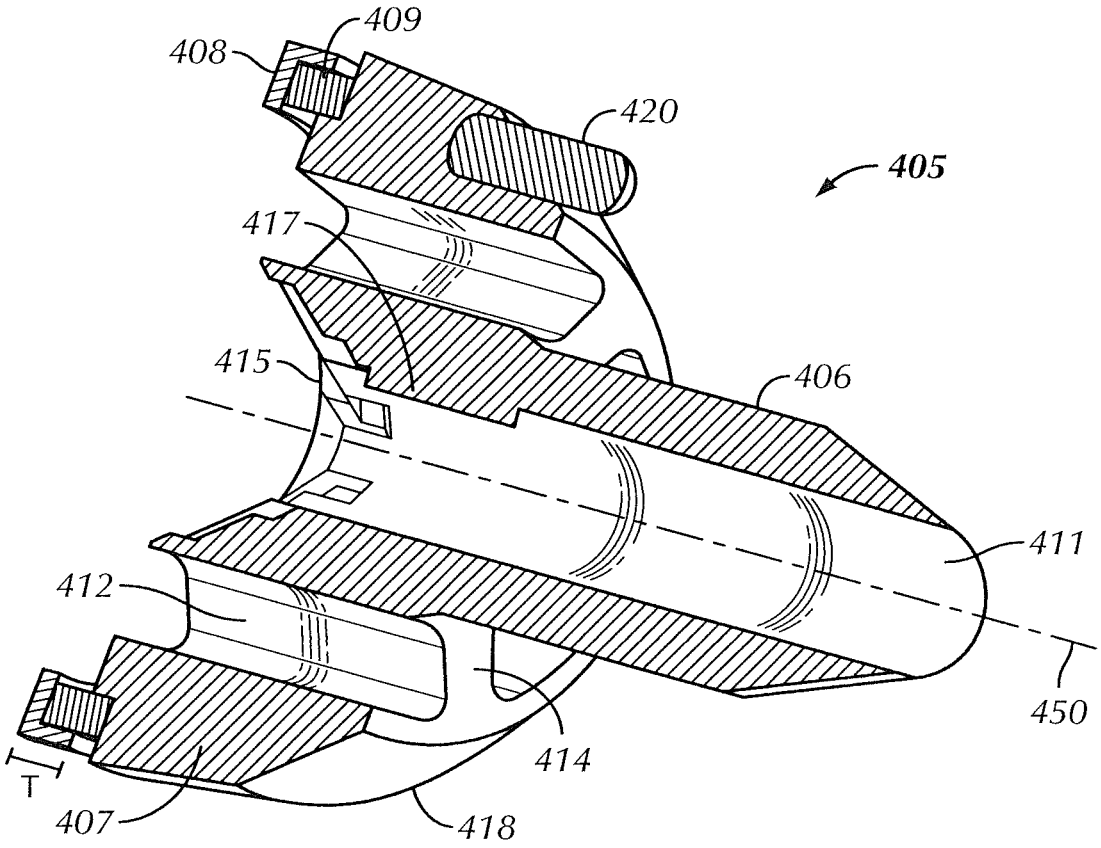
FIG. 4 shows a cross-sectional view of an anchoring block according to embodiments disclosed herein.

Referring to FIG. 4, a cross-section view of an anchoring block 405, in accordance with embodiments disclosed herein, is shown. As shown, the anchoring block 405 includes a body 406, a contact crown 407, and a contact ring 408. In one or more embodiments, the body 406 of the anchoring block 405 may have a central bore 411 formed therethrough and a central axis 450 defined therethrough. In one or more embodiments, the central bore 411 of the body 406 may be configured to receive at least one tool (not shown), e.g., an MWD tool and/or an LWD tool discussed above. Those having ordinary skill in the art will appreciate that the central bore 411 of the body 406 of the anchoring block 405 can be configured to receive any measurement tool(s) or logging tool(s) known in the art, as discussed above. Alternatively, the central bore 411 of the body 406 of the anchoring block 405 can be configured to receive other downhole tools or components that are not MWD tools or LWD tools. For example, as discussed above, in one or more embodiments, the central bore 411 of the body 406 may be configured to receive a dart (not shown) that may be part of a fishable MWD system.

As shown, the anchoring block 405 includes an alignment member 417 formed on an inner surface of the central bore 411 of the body 406. In one or more embodiments, the alignment member 417 may be configured to align at least one tool (not shown) disposed within the central bore 411 of the body 406 of the anchoring block 405. Further, as shown, the anchoring block 405 includes a support area 415 to support the at least one tool disposed within the central bore 411 of the anchoring block 405. The support area 415 may engage with the at least one tool and may be configured to provide a secure, specifically oriented engagement that is specific to the one or more tools. As discussed above, in one or more embodiments, the alignment member 417 may be a protrusion that is configured to engage with a corresponding groove, slot, or recess (not shown) formed on a surface of the at least one tool and may be used to control or measure the tool face or angular position of the at least one tool that is disposed within the central bore 411 of the anchoring block 405 by assisting with a specific alignment of the tool within the central bore 411. Alternatively, in one or more embodiments, the alignment member may be a groove, slot, or recess that is configured to engage with a corresponding protrusion formed on a surface of the at least one tool. In one or more embodiments, both the support area 415 and the alignment member 417 may guide or assist with a specific alignment, orientation, and/or engagement of a tool disposed within the central bore 411 of the anchoring block 405.

Further, as discussed above, in one or more embodiments, the contact crown 407 may be configured to engage with or contact at least a portion of a tubular member (not shown). As shown, a lower portion of the contact crown 407 of the anchoring block 405 includes a tapered portion 418, in which the tapered portion 418 of the contact crown 407 is configured to engage at least a portion of a tubular member, e.g., a portion of the female box connection 304 of the second tubular member 302 shown in FIG. 3. Those having ordinary skill in the art will appreciate that the lower portion of the contact crown 407 does not necessarily need to be linearly tapered in order to be configured to engage with or contact at least a portion of a tubular member. In one or more embodiments, the lower portion of the contact crown 407 of the anchoring block 405 may be configured to substantially match the surface to which the lower portion of the contact crown 407 is to engage. For example, in one or more embodiments, the lower portion of the contact crown 407 may be a rounded surface, a stepped surface, or any shape known in the art in order to provide secure engagement with a contact surface of a tubular member.

Furthermore, as discussed above, the contact ring 408 may be configured to engage or contact at least a portion of a tubular member, e.g., an end portion of the male pin connection 303 of the first tubular member 301 shown in FIG. 3. The contact ring 408 may be formed from any material known in the art. Further, in one or more embodiments, the contact ring 408 may be interchangeable on the anchoring block 405 with another contact ring (not shown) that may also be configured to engage with the rest of the anchoring block 405, but may have a different thickness T. In other words, in one or more embodiments, the contact ring 408 may be substituted for another contact ring having a different thickness T, which may be more appropriate in order to ensure secure engagement between the anchoring block 405 and elements of a tubular connection (not shown), e.g., the first tubular member 301 and the second tubular member 302 shown in FIG. 3, such that any space between the anchoring block 405 and the elements of a tubular connection may be minimized.

As discussed above, in one or more embodiments, the anchoring block 405 may include at least one biasing member 409. As shown, the biasing member 409 is disposed between the contact ring 408 and the contact crown 407 of the anchoring block 405. In one or more embodiments, the biasing member 409 may be configured to bias the contact ring 408 of the anchoring block 405 away from the contact crown 407. Similarly, in one or more embodiments, the biasing member 409 may be configured to bias the contact crown 407 away from the contact ring 408. Further, as discussed above, one or more embodiments of the anchoring block 405 may not necessarily include at least one biasing member 409.

In one or more embodiments, the anchoring block 405 may include a lock pin 420. In one or more embodiments, the lock pin 420 may be disposed in the contact crown 407 of the anchoring block 405. As shown, the lock pin 420 is disposed in the contact crown 407 of the anchoring block 405 in a direction that is substantially parallel to the central axis 450 of the anchoring block 405. Alternatively, in one or more embodiments, the lock pin 420 may be disposed in the contact crown 407 of the anchoring block 405 in a direction that is not parallel to the central axis 450 of the anchoring block 405.

Further, as shown, at least one annular flow channel 412 may be formed between the contact crown 407 and the body 406, and at least one connection wing 414 extends radially between the body 406 and the contact crown 407 of the anchoring block 405. In one or more embodiments, the annular flow channel 412 may allow fluid to flow or move through the anchoring block 305. Further, in one or more embodiments, the at least one connection wing 414 may provide a secure connection between the body 406 and the contact crown 407 of the anchoring block 405.

Figure 5:
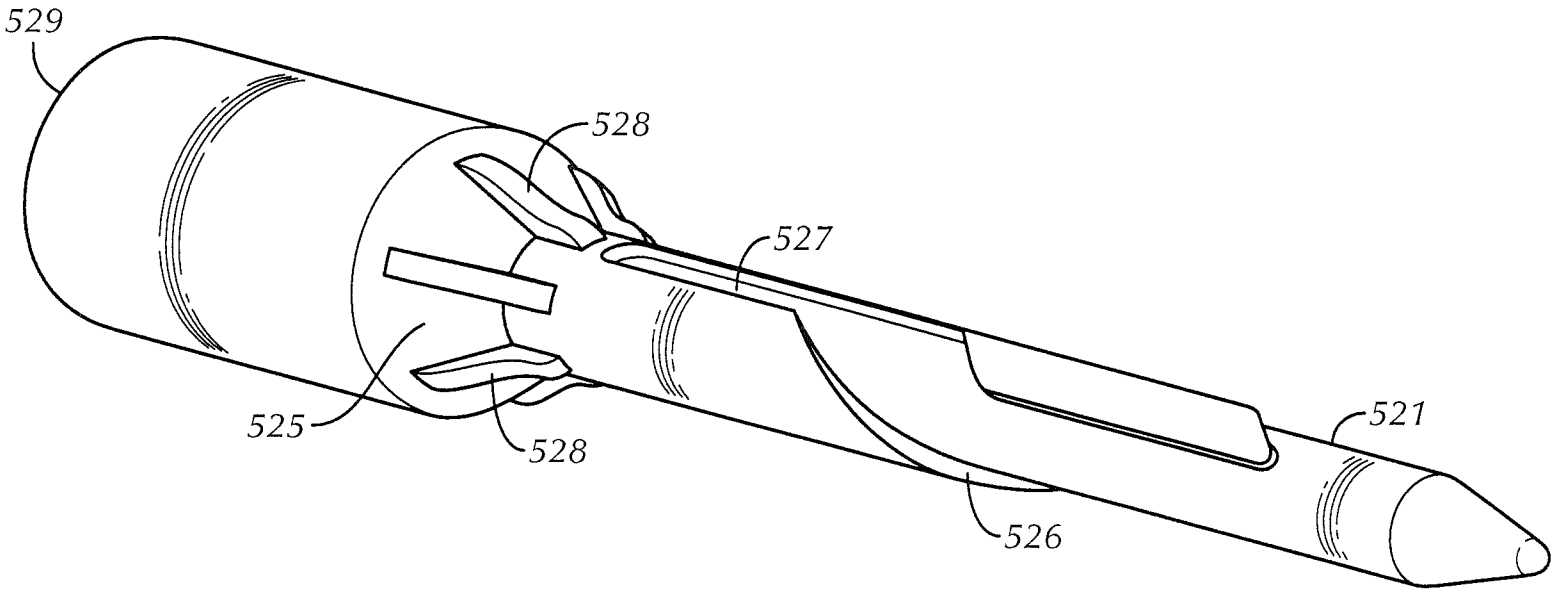
FIG. 5 shows a perspective view of a dart according to embodiments disclosed herein.

Referring to FIG. 5, a perspective view of a dart 521, in accordance with embodiments disclosed herein, is shown. In one or more embodiments, the dart 521 may be deployed downhole and may be used to locate downhole equipment and tools, such as measurement or logging tools discussed above. As shown, the dart 521 includes a groove 526 formed into a surface of the dart 521. In one or more embodiments, the groove 526 may be a spiral groove 526 and may provide guidance for specific angular rotation of the dart 521 within a bore (not shown) formed in an anchoring assembly (not shown). For example, in one or more embodiments, the spiral groove 526 may engage with an alignment member (not shown) of the anchoring assembly, e.g., the alignment member 317 of the anchoring block 305 shown in FIG. 3, which may guide or orient the dart 521 within a bore formed in an anchoring assembly. As shown, the dart 521 also includes a linear groove 527. In one or more embodiments, the linear groove 527 may also engage with an alignment member and may secure an axial orientation of the dart 521 within an anchoring assembly.

Further, as shown, the dart 521 includes an engagement surface 525 for engagement with a support area of an anchoring block (not shown), e.g., the support area 415 of the anchoring block 405 shown in FIG. 4, and a tool surface 529 for engagement with one or more measurement tools, discussed above. In one or more embodiments, the engagement surface 525 may include one or more orientation members 528 that may also be configured to engage with a support area of an anchoring block to provide increased support and engagement against any relative torque that may occur between the dart 521 and an anchoring assembly. In one or more embodiments, the orientation members 528 of the dart 521 may be a protrusion that is configured to engage with a corresponding groove, slot, or recess formed on a surface of a support area of an anchoring assembly. Alternatively, in one or more embodiments, the orientation members may be a groove, slot, or recess that is configured to engage with a corresponding protrusion formed on a surface of a support area of an anchoring assembly. In one or more embodiments, the tool surface 529 may be configured to engage with at least a portion of one or more measurement tools.

Figure 6:
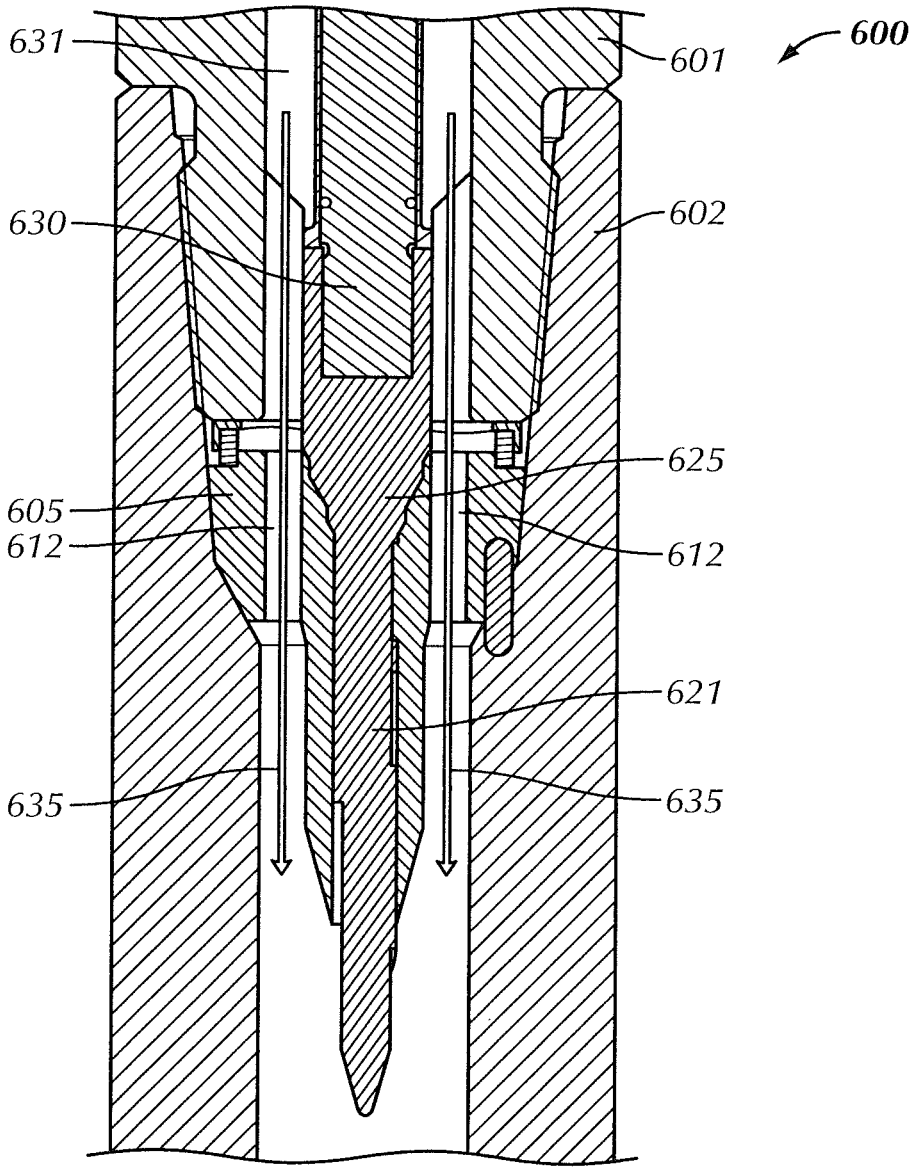
FIG. 6 shows a cross-sectional view of an anchoring assembly with a dart and a fishable measurement tool disposed therein according to embodiments disclosed herein.

Referring to FIG. 6, a cross-sectional view of an anchoring assembly 600 with a dart 621 and a fishable measurement tool 630 disposed therein, in accordance with embodiments disclosed herein, is shown. As shown, the anchoring assembly 600 includes a first tubular member 601, a second tubular member 602 that is coupled to the first tubular member 601, and an anchoring block 605 that is disposed between the first tubular member 601 and the second tubular member 602. Further, as shown, the dart 621 is disposed within a bore formed through the anchoring block 605 and engaged with the anchoring block 605. In one or more embodiments, an engagement surface 625 of the dart 621 may be engaged with a corresponding support area of the anchoring block 605, as discussed above. Furthermore, as shown, the fishable measurement tool 630 is engaged with the dart 621.

As shown, the fishable measurement tool 630 is also supported within the first tubular member 601 by a centralizer 631. Those having ordinary skill in the art will appreciate that one or more centralizers 631 may be disposed throughout the first tubular member 601 as well as other tubular members (not shown), which may be configured to engage and support the fishable measurement tool 630 and to help maintain a constant radial position of the fishable measurement tool 630 relative to the tubular member in which the fishable measurement tool 630 is disposed, e.g., the first tubular member 601.

As discussed above, in one or more embodiments, at least one annular flow channel 612 may be formed through the anchoring block 605. The annular flow channels 612 may allow fluid to flow or move through the anchoring block 605. As shown, the annular flow channels 612 may allow fluid to flow in the direction of arrows 635.

Figure 7:
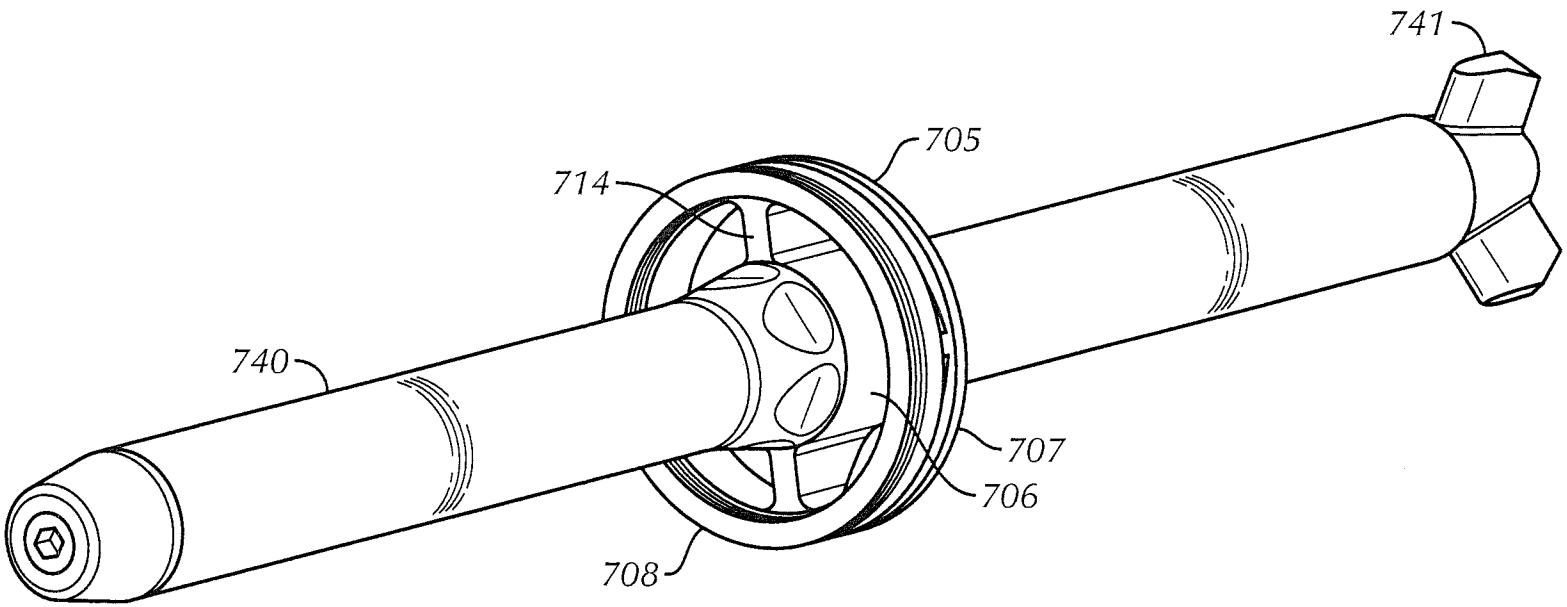
FIG. 7 shows a perspective view of an anchoring block engaged with a logging tool according to embodiments disclosed herein.

Referring to FIG. 7, a perspective view of an anchoring block 705 engaged with a logging tool 740, in accordance with embodiments disclosed herein, is shown. As shown, the anchoring block 705 includes a body 706, a contact crown 707, and a contact ring 708. As discussed above, the body 706 of the anchoring block 705 may have a central bore formed therethrough that may be configured to receive a tool, e.g., the logging tool 740. As shown, the logging tool 740 is securely disposed within the body 706 of the anchoring block 705. In one or more embodiments, an inner surface of the central bore formed through the body 706 of the anchoring block 705 may be threaded. Further, in one or more embodiments, a portion of an outer surface of the logging tool 740 may include a corresponding threaded surface that is configured to engage with the threaded inner surface of the central bore of the body 706. However, those having ordinary skill in the art will appreciate that the logging tool 740 may engage with the anchoring block 705 by any means other than a threaded connection known in the art.

Further, as shown, at least one connection wing 714 extends radially between the body 706 and the contact crown 707 of the anchoring block 705. Furthermore, in one or more embodiments, the logging tool 740 may include one or more alignments fins 741. In one or more embodiments, the alignment fins 741 may function as centralizers and/or may engage with centralizers disposed within a tubular member, e.g., the centralizers 631 shown in FIG. 6, in order to engage and support the logging tool 740 and to help maintain a constant radial position of the logging tool 740 relative to a tubular member in which the logging tool 740 is disposed, e.g., the first tubular member 601 shown in FIG. 6. Those having ordinary skill in the art will appreciate that the anchoring block 705 may be configured to receive and engage with any downhole tool or device and is not limited to receive and engage logging tools. For example, in one or more embodiments, the anchoring block 705 may be configured to receive and engage MWD tools, LWD tools, a dart, and/or any other downhole tool or device known in the art.

Figure 8A:
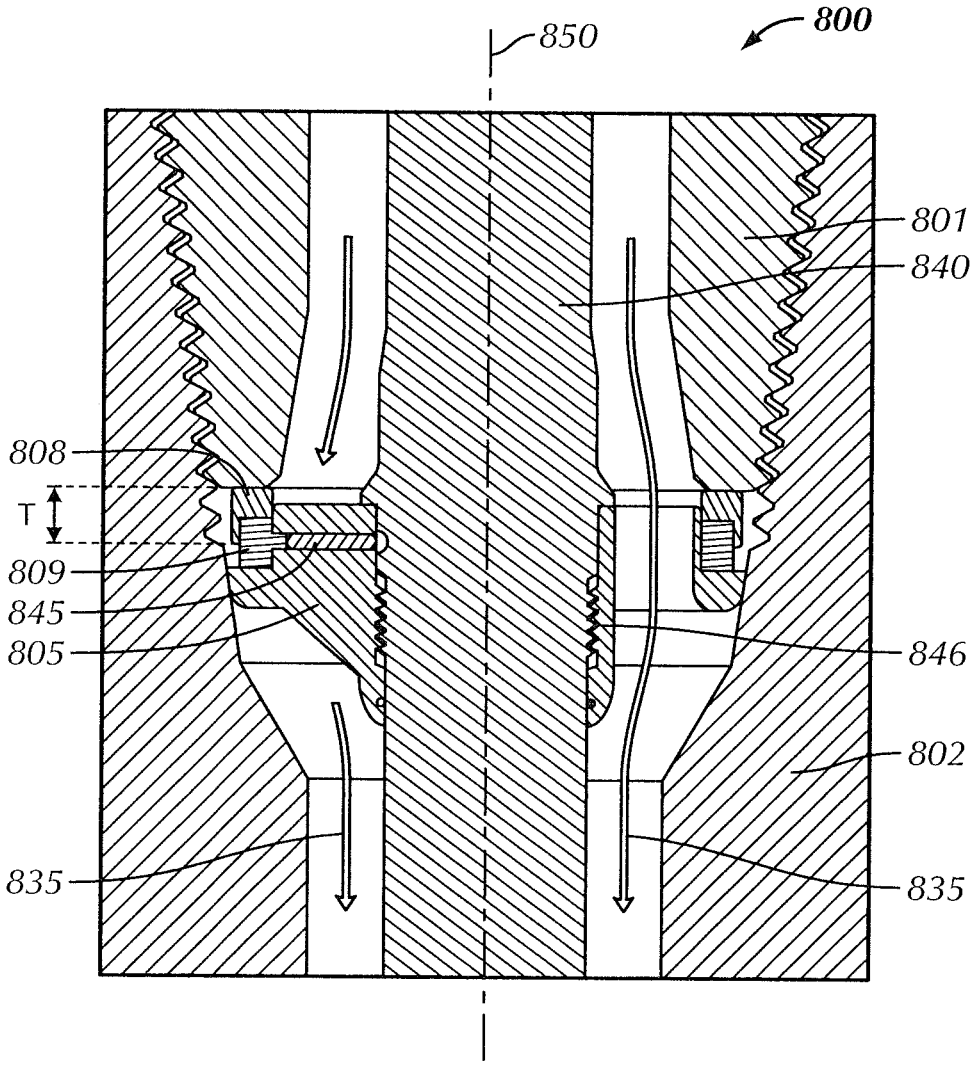
FIGS. 8A-8B show cross-sectional views of an anchoring assembly engaged with a logging tool according to embodiments disclosed herein.
Figure 8B:
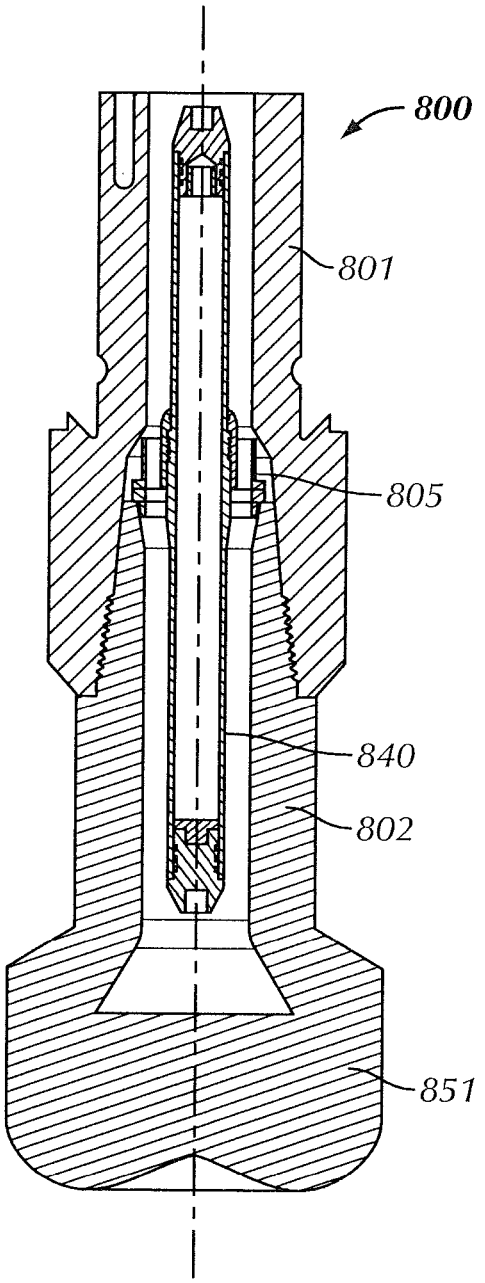

Referring to FIGS. 8A and 8B, cross-sectional views of an anchoring assembly 800 engaged with a logging tool 840, in accordance with embodiments disclosed herein, are shown. As shown, the anchoring assembly 800 includes a first tubular member 801, a second tubular member 802 that is coupled to the first tubular member 801, and an anchoring block 805 that is disposed between the first tubular member 801 and the second tubular member 802. As discussed above, in one or more embodiments, the first tubular member 801 may be threadably coupled to the second tubular member 802.

As discussed above, the anchoring block 805 may include a body, a contact crown, and a contact ring 808. In one or more embodiments, the body and the contact crown may be considered a single body having one or more annular flow channels (not shown) formed therethrough, which may allow fluid to flow through the anchoring block 805 in a direction of arrows 835. As shown, the anchoring block 805 has a central bore formed therethrough and a logging tool 840 disposed in the central bore of the anchoring block 805. As discussed above, an inner surface of the central bore formed through the anchoring block 805 may be threaded and a portion of an outer surface of the logging tool 840 may include a corresponding threaded surface that is configured to engage with the threaded inner surface of the central bore of the anchoring block 805, forming a threaded connection 846.

Furthermore, as discussed above, in one or more embodiments, the anchoring block 805 may include at least one biasing member 809. In one or more embodiments, the biasing member 809 may be configured to bias the contact ring 808 of the anchoring block 805 toward a portion of the first tubular member 801. As discussed above, one or more embodiments of the anchoring block 805 may not necessarily include at least one biasing member 809.

In one or more embodiments, the anchoring assembly 800 may include an anti-backoff pin 845. In one or more embodiments, the anti-backoff pin 845 may provide resistance to axial rotation of the logging tool 840 relative to the anchoring block 805 such that the logging tool 840 may not become inadvertently disengaged from the anchoring block 805 during downhole use. As shown, the anti-backoff pin 845 is disposed in a direction that is substantially perpendicular to a central axis 850 of the anchoring block 805. Alternatively, in one or more embodiments, the anti-backoff pin 845 may be disposed into the anchoring block 805 in a direction that is not perpendicular to the central axis 850 of the anchoring block 805. For example, in one or more embodiments, the anti-backoff pin 845 may be disposed into the anchoring block 805 in any direction relative to the central axis 850 of the anchoring block 805.

In one or more embodiments, several small holes (not shown) may be machined into a periphery of the logging tool 840 that may be configured to allow the anti-backoff pin 845 to be received within at least one of the small holes after a minimum rotation of the threaded connection 846 between the logging tool 840 and the anchoring block 805.

As shown in FIG. 8B, the second tubular member 802 may be a tubular member coupled to or integral with a drill bit 851. Although the second tubular member 802 may be coupled to or integral with a drill bit 851, those having ordinary skill in the art will appreciate that each of the first tubular member 801 and the second tubular member 802 may be any tubular members known in the art and are not necessarily limited to tubular members coupled to or integral with drill bits.

According to another aspect, method of assembling an anchoring assembly, according to embodiments disclosed herein, may include providing a first tubular member and a second tubular member, e.g., the first tubular member 301 and the second tubular member 302 shown in FIG. 3, and providing a gauge apparatus. In one or more embodiments, the gauge apparatus may include an external member having a first end, a second end, a central axis defined therethrough, and a central bore formed therethrough, and an internal member disposed within the central bore of the external member, the internal member having a first end, a second end, and a central bore formed therethrough.

The method of assembling an anchoring assembly may also include engaging each of the second end of the external member and the second end of the internal member of the gauge apparatus with the second tubular member, disengaging the second end of the external member of the gauge apparatus from the second tubular member, disposing an anchoring block into the central bore of the internal member of the gauge apparatus, engaging each of the first end of the external member and the first end of the internal member of the gauge apparatus with the first tubular member, and selecting a contact ring for the anchoring block based on a displacement of the internal member of the gauge apparatus.

Figure 9:
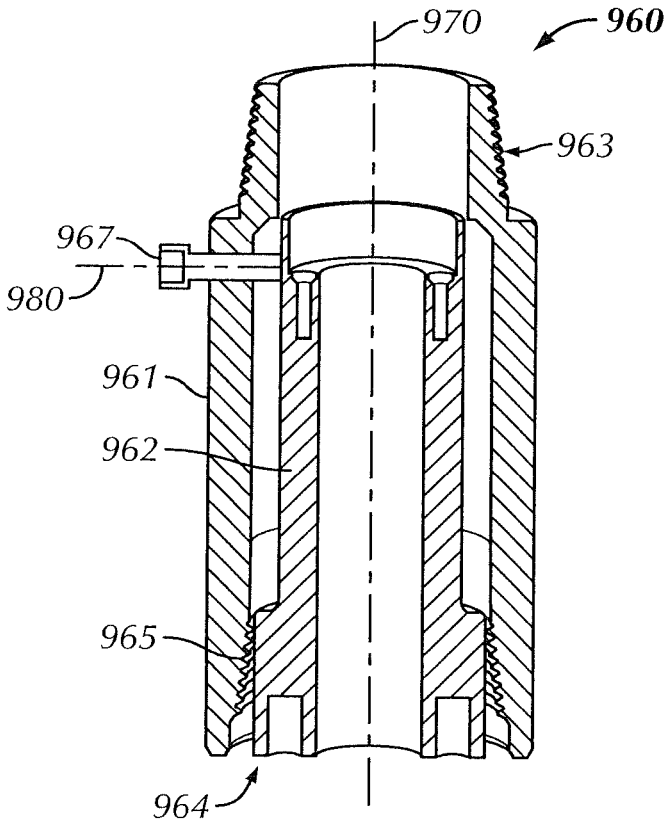
FIG. 9 shows a cross-sectional view of a gauge apparatus according to embodiments disclosed herein.

Referring to FIG. 9, a gauge apparatus 960, in accordance with embodiments disclosed herein, is shown. As shown, the gauge apparatus 960 includes an external member 961 and an internal member 962. In one or more embodiments, the external member 961 may have a central axis 970 defined therethrough, a central bore formed therethrough, a first end 963, and a second end 964. As shown, the first end 963 of the external member 961 of the gauge apparatus 960 is a male pin connection. This pin is shorter in reference to the standard definition. Further, as shown, the second end 964 of the external member 961 of the gauge apparatus 960 is a female box connection. Alternatively, in one or more embodiments, the first end 963 of the external member 961 of the gauge apparatus 960 may be a female box connection, and the second end 964 of the external member 961 of the gauge apparatus 960 may be a male pin connection.

Those having ordinary skill in the art will appreciate that each of the first end 963 and the second end 964 of the external member 961 of the gauge apparatus 960 may not necessarily be limited to threaded connections. As discussed above, according to one or more embodiments, the tubular connections of the anchoring assembly are not limited only to threaded connections, but may be connected or engaged by any connections means known in the art. As such, in one or more embodiments, because each of the first end 963 and the second end 964 of the external member 961 of the gauge apparatus 960 may be configured to substantially engage with a first tubular member and a second tubular member, respectively, each of the first end 963 and the second end 964 of the external member 961 of the gauge apparatus 960 are also not limited to threaded connections.

In one or more embodiments, the internal member 962 may be disposed within the central bore formed through the external member 961, and the internal member 962 may include a first end, a second end, a central bore formed therethrough. In one or more embodiments, both an internal surface of the external member 961 and an external surface of the internal member 962 of the gauge apparatus 960 may include gauge threads 965, by which the internal member 962 may engage with the external member 961. As such, in one or more embodiments, the internal member 962 may be engaged and secured within the central bore of the external member 961. In other words, an axial position of the internal member 962 may be secured through the gauge threads 965. However, in one or more embodiments, the axial position of the internal member 962 may be manipulated or changed relative to the external member 961 by rotating the internal member 962 relative to the external member 961, thereby displacing the internal member 962 along the central axis 970 of the external member 961 by way of the gauge threads 965. A pitch of the gauge threads 965 may be known, and a displacement of the internal member 962 relative to the external member 961 may be calculated using the pitch of the gauge threads 965 and the number of rotations of the internal member 962 of the gauge apparatus 960.

Furthermore, in one or more embodiments, the gauge apparatus 960 may include an engagement member 967. In one or more embodiments, the engagement member 967 may be disposed through the external member 961 and may be configured to engage with a surface of the internal member 962. As shown, the engagement member 967 is disposed in a direction that is substantially perpendicular to the central axis 970 of the gauge apparatus 960. Alternatively, in one or more embodiments, the engagement member 967 may be disposed through the external member 961 in a direction that is not perpendicular to the central axis 970 of the gauge apparatus 960. For example, in one or more embodiments, the engagement member 967 may be disposed through the external member 961 in any direction relative to the central axis 970 of the gauge apparatus 960.

In one or more embodiments, the engagement member 967 may be threadably engaged with the external member 961, such that a radial position of the engagement member 967 may be precisely controlled. For example, because the engagement member 967 may be threadably engaged with the external member 961, the radial position of the engagement member may be controlled by rotating the engagement member 967 about a central axis 980 of the engagement member 967. In one or more embodiments, the threads of the threaded engagement between the engagement member 967 and the external member 961 may allow a user to control the radial position of the engagement member 967 by maintaining the radial position of the engagement member 967 until the engagement member 967 is rotated about the central axis 980, whereby the radial position of the engagement member 967 may be changed based on the number or rotations of the engagement member 967 about the central axis 980. However, those having ordinary skill in the art will appreciate that the engagement member 967 of the gauge apparatus 960 is not limited to being threadably engaged with the external member 961. In one or more embodiments, the engagement member 967 of the gauge apparatus 960 may be engaged with the external member 961 by any means known in the art such that the radial position of the engagement member 967 may be controlled.

Figure 10A:
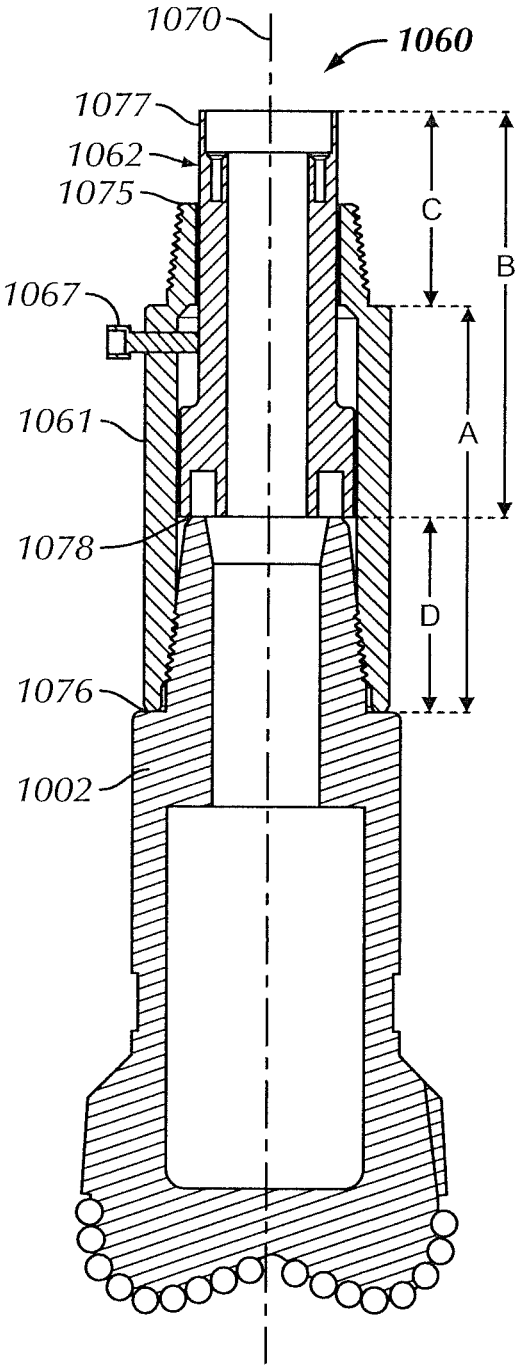
FIGS. 10A-10B show cross-sectional views of a use of a gauge apparatus according to embodiments disclosed herein.
Figure 10B:
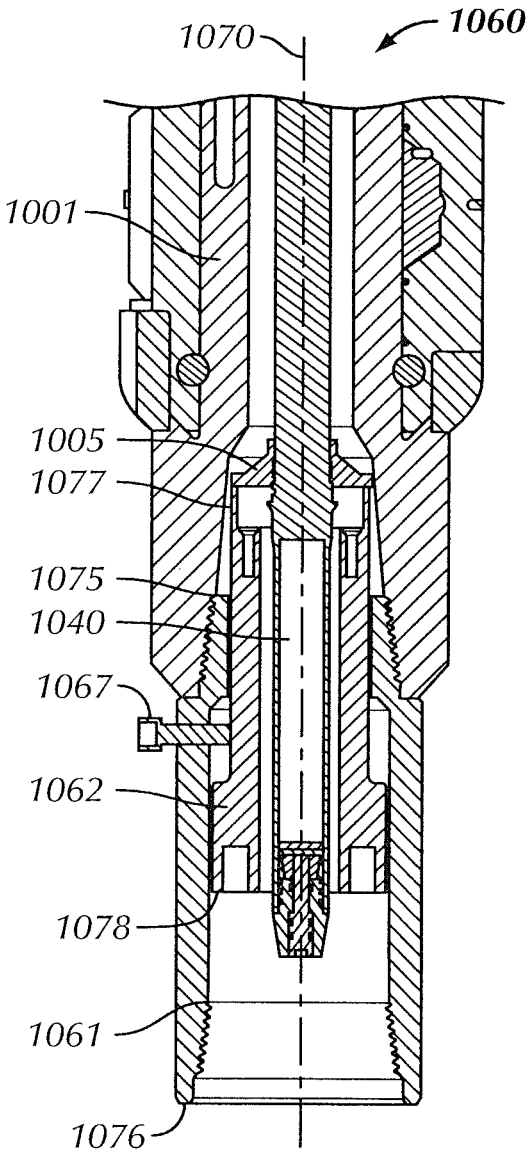

Referring to FIGS. 10A and 10B, cross-sectional views of a use of a gauge apparatus, in accordance with embodiments disclosed herein, are shown. The use of a gauge apparatus, according to embodiments disclosed herein, may include, in part, assembling an anchoring assembly, e.g., the anchoring assembly 300 shown in FIG. 3. The method of assembling an anchoring assembly may include proving a first tubular member 1001 and a second tubular member 1002 and a gauge apparatus 1060.

As shown in FIG. 10A, a gauge apparatus 1060 is coupled to a second tubular member 1002. In one or more embodiments, the gauge apparatus 1060 may include an external member 1061 and an internal member 1062. In one or more embodiments, the external member 1061 may include a first end 1075 and a second end 1076, and the internal member 1062 may include a first end 1077 and a second end 1078. In one or more embodiments, the first end 1075 of the external member 1061 may be a threaded male pin connection that is substantially similar to a male pin connection of the second tubular member 1002. Similarly, in one or more embodiments, the second end 1076 of the external member 1061 may be a threaded female box connection that is substantially similar to a female box connection of a first tubular member 1001. Those having ordinary skill in the art will appreciate that the first end 1075 and the second end 1076 of the external member 1061 are not necessarily limited to being a male pin connection and a female box connection, respectively. Each of the first end 1075 and the second end 1076 of the external member 1061 may be configured or adapted to engage with corresponding connection members of the first tubular member 1001 and the second tubular member 1002.

The method of assembling the anchor assembly may also include engaging the second end 1076 of the external member 1061 with a first end, e.g., the male pin connection, of the second tubular member 1002 such that the second end 1076 of the external member 1061 of the gauge apparatus 1060 is fully engaged with the second tubular member 1002, as shown in FIG. 10A. Further, the method of assembling the anchor assembly may also include engaging the second end of 1078 of the internal member 1062 with the first end, e.g., a tip or extremity of the male pin connection, of the second tubular member 1002 such that the second end 1078 of the internal member 1062 of the gauge apparatus 1060 is fully engaged with the second tubular member 1002, as shown in FIG. 10A. As such, in one or more embodiments, a pin length C of the gauge apparatus 1060 may be substantially equal to a pin length D of the first tubular member 1001, as a gauge length A may be substantially equal to a length B of the internal member 1062.

As discussed above, both an internal surface of the external member 1061 and an external surface of the internal member 1062 of the gauge apparatus 1060 may include gauge threads (not shown), by which the internal member 1062 may engage with the external member 1061. As such, in one or more embodiments, the internal member 1062 may be engaged and secured within the central bore of the external member 1061. In other words, an axial position of the internal member 1062 may be secured through the gauge threads. However, in one or more embodiments, the axial position of the internal member 1062 may be manipulated or changed relative to the external member 1061 by rotating the internal member 1062 relative to the external member 1061, thereby displacing the internal member 1062 along a central axis 1070 of the external member 1061 by way of the gauge threads.

The method of assembling the anchor assembly may also include engaging an engagement member 1067 of the gauge apparatus 1060 with the internal member 1062. In one or more embodiments, engaging the engagement member 1067 of the gauge apparatus 1060 with the internal member 1062 may provide engagement or reinforced engagement of the internal member 1062 within the external member 1061.

The method of assembling the anchor assembly may also include disengaging the second end 1076 of the external member 1061 of the gauge apparatus 1060 from the second tubular member 1002 and disposing an anchoring block 1005 into a central bore formed through the internal member 1062 of the gauge apparatus 1060. Further, the method may include engaging each of the first end 1075 of the external member 1061 and the first end 1077 of the internal member 1062 of the gauge apparatus 1060 with the first tubular member 1001, as shown in FIG. 10B.

As discussed above, the anchoring block 1005 may include a body having a central axis defined therethrough and a central bore formed therethrough, and a contact crown, in which at least one annular flow channel is formed between the contact crown and the body. Further, as discussed above, the anchoring block 1005 may have a central bore formed therethrough and may be configured to receive at least one tool 1040, as described above. The method of assembling the anchor assembly may include disposing or engaging at least one tool within the central bore of the anchoring block 1005. Further, as discussed above, the anchoring block 1005 may include a contact ring that may be coupled or engaged directly or indirectly with the contact crown and/or the body of the anchoring block 1005. As discussed above, in one or more embodiments, the contact ring may be substituted with a similar contact ring having a different thickness in order to securely engage the anchoring block 1005 between the first tubular member 1001 and the second tubular member 1002.

In one or more embodiments, once the first end 1075 of the external member 1061 is engaged with the first tubular member 1001, the first end 1077 of the internal member 1062 of the gauge apparatus 1060 may be engaged with the first tubular member 1001. This may be accomplished by rotating the internal member 1062 relative to the external member 1061, which may cause the internal member 1062 to be axially displaced along the central axis 1070 of the gauge apparatus 1060 as a result of a threaded engagement between the internal member 1062 and the external member 1061, as discussed above.

In one or more embodiments, the internal member 1062 may be axially displaced along the central axis 1070 of the gauge apparatus 1060 until the first end 1077 of the internal member 1062 contacts the anchor block 1005, which contacts or engages at least a portion of the first tubular member 1001. As discussed above, the pitch of the threads of the threaded engagement between the internal member 1062 and the external member 1061 may be known. As such, in one or more embodiments, the total displacement of the internal member 1062 relative to the external member 1061 may be determined by the pitch of the threads of the threaded engagement between the internal member 1062 and the external member 1061 and the number or rotations of the internal member 1062 within the central bore formed through the external member 1061 required for the first end 1077 of the internal member 1062 to contact the anchor block 1005, which contacts or engages at least a portion of the first tubular member 1001 from the initial axial position of the internal member 1062. The initial axial position of the internal member 1062 may be established by the pin height D of the second tubular member 1002, shown in FIG. 10A and discussed above.

Alternatively, in one or more embodiments, the anchoring block 1005 may be disposed within, or engaged with, the internal member 1062 of the gauge apparatus. Once the anchoring block 1005 is engaged with the internal member 1062, the internal member 1062 may be axially displaced along the central axis 1070 of the gauge apparatus 1060 until a portion of the anchoring block 1005 contacts or engages at least a portion of the first tubular member 1001. Again, in one or more embodiments, the total displacement of the internal member 1062 relative to the external member 1061 may be determined by the pitch of the threads of the threaded engagement between the internal member 1062 and the external member 1061 and the number or rotations of the internal member 1062 within the central bore formed through the external member 1061 required for the anchoring block 1005 to contact or engage at least a portion of the first tubular member 1001 from the initial axial position of the internal member 1062.

In one or more embodiments, a contact ring (not shown) may be selected for the anchoring block 1005 based on this determined displacement of the internal member 1062 relative to the external member 1061 of the gauge apparatus 1060. Dimensions of other components of the anchoring block 1005, e.g., a height of the contact crown or a height of the body, may be known, and a contact ring of suitable thickness may be selected to provide secure engagement of anchoring block 1005 within a tubular connection. As discussed above, a contact ring may be substituted for another contact ring having a different thickness, which may be more appropriate in order to ensure secure engagement between the anchoring block 1005 and each of the first tubular member 1001 and the second tubular member 1002, such that any space between the anchoring block 1005 and each of the first tubular member 1001 and the second tubular member 1002 may be minimized. A complaint element, such as a spring (not shown), may be added between the anchoring block 1005 and the contact ring to compensate for any additional thickness variation.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. An anchoring assembly, the assembly comprising:
- a first tubular member;
- a second tubular member coupled to the first tubular member; and
- an anchoring block disposed between the first tubular member and the second tubular member, the anchoring block comprising:
  - a body having a central axis defined therethrough and a central bore formed therethrough;
  - a contact crown, wherein at least one annular flow channel is formed between the contact crown and the body;
  - a contact ring configured to engage at least a portion of the first tubular member; and
  - at least one biasing member disposed between the contact ring and the contact crown, wherein the at least one biasing member is configured to exert force on the contact ring and on the contact crown and securely engage the anchoring block between the first tubular member and the second tubular member.

2. The assembly of claim 1, wherein the central bore of the body of the anchoring block is configured to receive at least one tool.

3. The assembly of claim 2, the anchoring block further comprising an alignment member formed on an inner surface of the central bore of the body, wherein the alignment member is configured to align the at least one tool disposed within the central bore of the body of the anchoring block.

4. The assembly of claim 1, the anchoring block further comprising a lock pin, wherein the lock pin is disposed in the contact crown of the anchoring block in a direction that is parallel to the central axis of the anchoring block.

5. The assembly of claim 1, wherein a lower portion of the contact crown of the anchoring block comprises a tapered portion, wherein the tapered portion of the contact crown is configured to engage at least a portion of the second tubular member.

6. The assembly of claim 1, wherein at least one connection wing extends radially between the body and the contact crown of the anchoring block.

7. An anchoring block, the block comprising:

a body having a central axis defined therethrough and a central bore formed therethrough;

a contact crown, wherein at least one annular flow channel is formed between the contact crown and the body;

a contact ring configured to engage at least a portion of a first tubular member; and at least one biasing member disposed between the contact ring and the contact crown, wherein the at least one biasing member is configured to exert force on the contact ring and securely engage the first tubular member.

8. The anchoring block of claim 7, wherein the central bore is configured to receive at least one tool.

9. The anchoring block of claim 8, further comprising an alignment member formed on an inner surface of the central bore of the body, wherein the alignment member is configured to align the at least one tool disposed within the central bore of the body.

10. The anchoring block of claim 7, further comprising a lock pin, wherein the lock pin is disposed in the contact crown in a direction that is parallel to the central axis of the anchoring block.

11. The anchoring block of claim 7, wherein a lower portion of the contact crown comprises a tapered portion.

* * * * *